US010508795B2

(12) United States Patent
Vice, Jr. et al.

(10) Patent No.: US 10,508,795 B2
(45) Date of Patent: Dec. 17, 2019

(54) ADJUSTABLE ASSEMBLY FOR AN ADJUSTABLE DOWNLIGHT

(71) Applicant: Focal Point, LLC, Chicago, IL (US)

(72) Inventors: Edwin Vice, Jr., Chicago, IL (US); Ken Czech, Naperville, IL (US)

(73) Assignee: Focal Point, LLC, Chicago, IL (US)

( * ) Notice: Subject to any disclaimer, the term of this patent is extended or adjusted under 35 U.S.C. 154(b) by 0 days.

(21) Appl. No.: 15/686,912

(22) Filed: Aug. 25, 2017

(65) Prior Publication Data

US 2019/0063724 A1 Feb. 28, 2019

(51) Int. Cl.

| | |
|---|---|
| ***F21V 17/02*** | (2006.01) |
| ***F21V 29/76*** | (2015.01) |
| ***F21V 21/30*** | (2006.01) |
| ***F21S 8/02*** | (2006.01) |
| ***F21V 17/12*** | (2006.01) |
| ***F21V 17/16*** | (2006.01) |

(52) U.S. Cl.

CPC ..... *F21V 17/02* (2013.01); *F21S 8/026* (2013.01); *F21V 17/12* (2013.01); *F21V 17/162* (2013.01); *F21V 21/30* (2013.01); *F21V 29/763* (2015.01)

(58) Field of Classification Search

USPC ..... 362/365

See application file for complete search history.

(56) References Cited

U.S. PATENT DOCUMENTS 6,974,233 B1 * 12/2005 Aubrey ..... F21V 19/0065 362/294

* cited by examiner

*Primary Examiner* — Rafferty D Kelly

(74) *Attorney, Agent, or Firm* — Banner & Witcoff, Ltd.

(57) ABSTRACT

An adjustable assembly for an adjustable downlight fixture assembly with a heatsink comprising a plurality of cooling fins that is connected to a mounting bracket where the heatsink is tiltably engaged with the mounting bracket. The heatsink is configured to receive a light source and may tilt within a confined space of the downlight fixture assembly up to 45 degrees from a vertical plane. The mounting bracket comprises a first side wall and a second side wall with a front wall connected between them where the first side wall and second side wall are connected to a rotation ring that is rotatably engaged with the frame of the downlight fixture.

12 Claims, 14 Drawing Sheets

ADJUSTABLE ASSEMBLY FOR AN ADJUSTABLE DOWNLIGHT

TECHNICAL FIELD

This disclosure relates to a tiltable and rotatable adjustable assembly for an adjustable downlight.

BACKGROUND

Removing the heat generated by a light source is important to extend the life and keep the light fixture functioning properly. This is typically accomplished by using a heat sink. As downlight fixtures are sometimes mounted within walls or ceilings, they need to fit into small and sometimes confined spaces. In addition, the downlight fixture may need to be adjusted to tilt the light source to project the light beam in a direction at an angle to its mounting surface. When tilting the light source, however, the space limitations may limit the amount the light source may be tilted. In addition, when the light source is tilted, a user may be required to use a variety of tools to tilt the light source. An adjustable assembly with a heatsink for an adjustable downlight that can be tilted along with the light source in a simple manner and allows an operator to adjust the downlight without tools would be a benefit.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this disclosure may relate to an adjustable assembly for a downlight comprising a heatsink configured to receive a light source, where the heatsink comprises a plurality of cooling fins and is connected to a mounting bracket. The mounting bracket may be connected to a rotation ring that is rotatably engaged to a downlight fixture assembly. The rotation ring may be releasably connected to the mounting bracket and configured to connect to a downlight fixture assembly to allow for the rotation of a tilted light source. The rotation ring may have a top surface and a bottom surface with a first tab extending away from the top surface and a second tab extending away from the top surface. The mounting bracket may include a first side wall having a first plurality of slots extending through the first side wall, where the first side wall is connected to the rotation ring, and a second side wall having a second plurality of slots extending through the second side wall, where the second side wall is connected to the rotation ring. A front wall may extend between the first side wall and the second side wall. The heatsink may be positioned between the first side wall and the second side wall. The heatsink may be connected to the first side wall with a first set of securing members extending through the first plurality of slots and may also be connected to the second side wall with a second set of securing members extending through the second plurality of slots. The heatsink may be tiltably engaged with the mounting bracket.

Other aspects of this disclosure may relate to a tension spring having a first end attached to the front wall and a second end engaged with a plurality of locking steps positioned along an upper surface of at least one cooling fin of the heatsink, where the tension spring applies a tension force to the plurality of locking steps to keep the heatsink in a fixed position. The heatsink is tilted by the securing members slidable engagement along the first plurality of slots and the second plurality of slots to overcome the tension force of the tension spring to allow ratcheting of the tension spring into different angles of the locking steps along an upper surface of the heatsink, where the tilting of the heatsink tilts a light beam from the light source. The plurality of locking steps may also include individual locking steps that are spaced to correspond to an angular increment for the heatsink to provide incremental fine angle tilt adjustment of the heatsink. The heatsink may tilt within a range of 0 degrees to 45 degrees from a vertical plane. The plurality of locking steps is centered upon a centerline of the heatsink between the first side wall and second side wall.

Yet other aspects of this disclosure may relate to a downlight fixture assembly comprising: a plaster frame; a trim assembly mounted to a lower surface of the plaster frame; and an adjustable assembly mounted to an upper surface of the plaster frame and substantially centered over the trim assembly. The adjustable assembly may comprise a mounting bracket including a first side wall having a first pair of arcuate slots, a second side wall having a second pair of arcuate slots opposite the first side wall, and a front wall extending between the first side wall and the second side wall. A rotation ring may be connected to the first side wall and the second side wall, where the rotation ring is rotatably engaged with the plaster frame. The heatsink may be configured to receive a light source, and comprise a plurality of cooling fins, where the heatsink is positioned between the first side wall and the second side wall. The heatsink may be connected to the first side wall with a first set of securing members extending through the first pair of slots and may be connected to the second side wall with a second set of securing members extending through the second pair of slots. The heatsink may be tiltably engaged with the first side wall and the second side wall and the heatsink tilts by slidably engaging the first set of securing members and the second set of securing members along the slots thereby tilting a light beam from the light source. The adjustable assembly may further include a tension spring having a first end attached to the front wall and a second end engaged with a plurality of locking steps positioned along an upper surface of at least one cooling fin of the heatsink. The tension spring applies a tension force to the plurality of locking steps to keep the heatsink in a fixed position. The heatsink may be tilted by slidably engaging along the first and second pair of slots to overcome the tension force of the tension spring to allow ratcheting of the tension spring into different angle locking steps along the upper surface of the heatsink.

BRIEF DESCRIPTION OF THE DRAWINGS

The present invention is illustrated by way of example and not limited in the accompanying figures in which like reference numerals indicate similar elements and in which.

Figure 1:
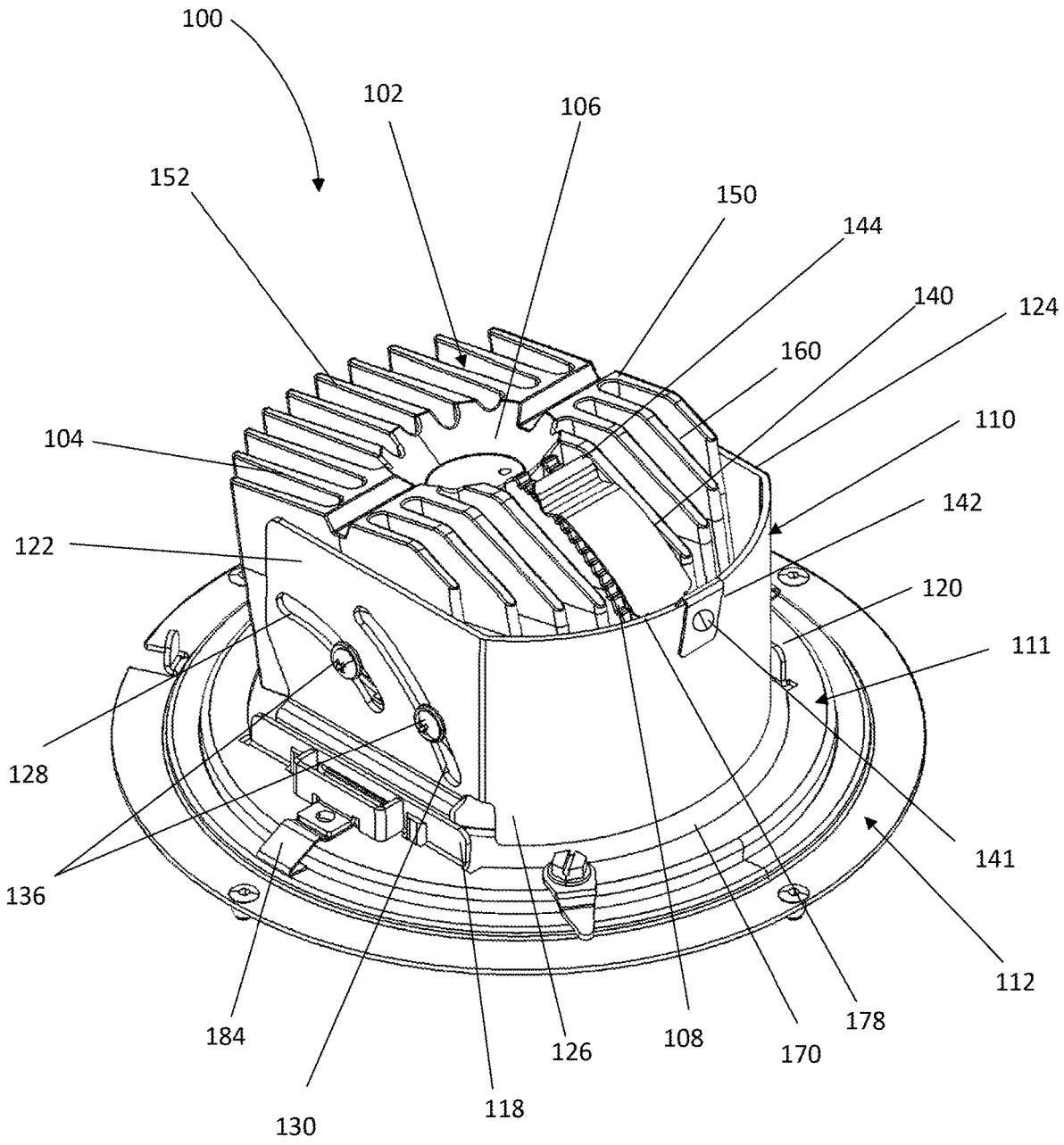
FIG. 1 illustrates a top front perspective view of an example embodiment of an adjustable assembly in a tilted position according to one or more aspects described herein.

Further, it is to be understood that the drawings may represent the scale of different components of one single embodiment; however, the disclosed embodiments are not limited to that particular scale.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Nothing in this specification should be construed as requiring a specific three dimensional orientation of structures in order to fall within the scope of this invention.

The following terms are used in this specification, and unless otherwise noted or clear from the context, these terms have the meanings provided below.

"Generally parallel" means that a first line, segment, plane, edge, surface, etc. is approximately (in this instance, within 5%) equidistant from with another line, plane, edge, surface, etc., over at least 50% of the length of the first line, segment, plane, edge, surface, etc.

"Generally perpendicular" means that a first line, segment, plane, edge, surface, etc. is approximately (in this instance, within 5%) oriented approximately 90 degrees from another line, plane, edge, surface, etc., over at least 50% of the length of the first line, segment, plane, edge, surface, etc.

"Plurality" indicates any number greater than one, either disjunctively or conjunctively, as necessary, up to an infinite number.

Generally, this disclosure relates to an adjustable assembly 100 with a heatsink 102 configured to receive a light source, which may be an LED type light source or other light source, that mounts to a downlight fixture assembly 10. The heatsink 102 can tilt relative to a mounting bracket 110 thereby tilting a light beam of the light source. The tilting of the heatsink 102 allows an operator to adjust and tilt the light beam of the light source within a confined space up to 45 degrees. The heatsink 102 can also rotate relative to a mounting plate 112 thereby directing the tilted light beam of the light source. A rotation ring 111 may be rotatably engaged to a downlight fixture assembly 10 to allow the heatsink 102 and the light source to rotate up to and including 360 degrees around the trim assembly 20. Further, the operator can adjust, tilt, and rotate the heatsink 102 and light beam of the light source without using a tool, which makes for a less time consuming and easy adjustment of the light beam of the light source. The adjustable assembly 100 may remain fixed until an outside force is applied to the adjustable assembly 100 to adjust its orientation either rotationally or tiltably.

Figure 3:
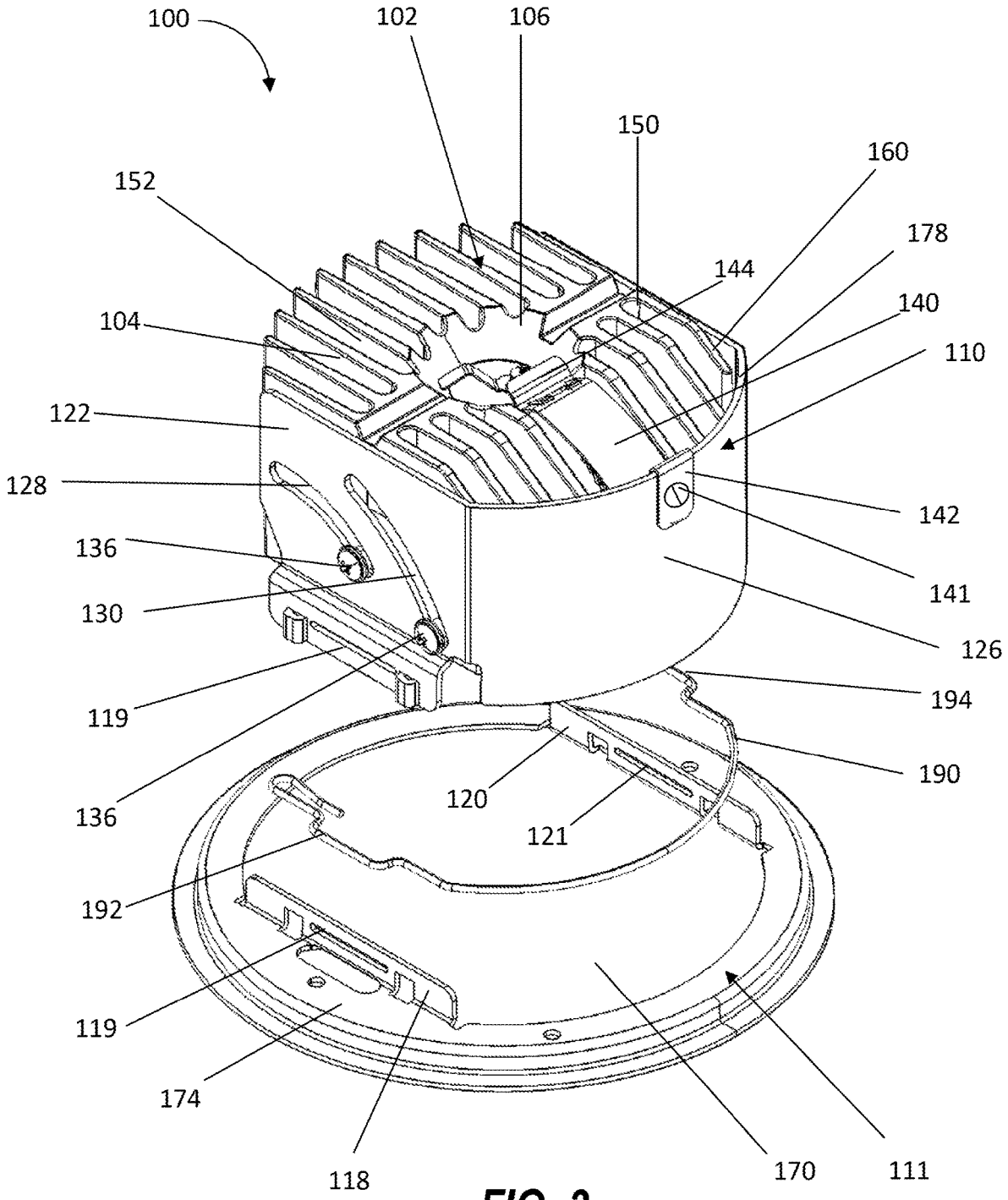
FIG. 3 illustrates an exploded view of the example embodiment of the adjustable assembly of FIG. 1 according to one or more aspects described herein.
Figure 4:
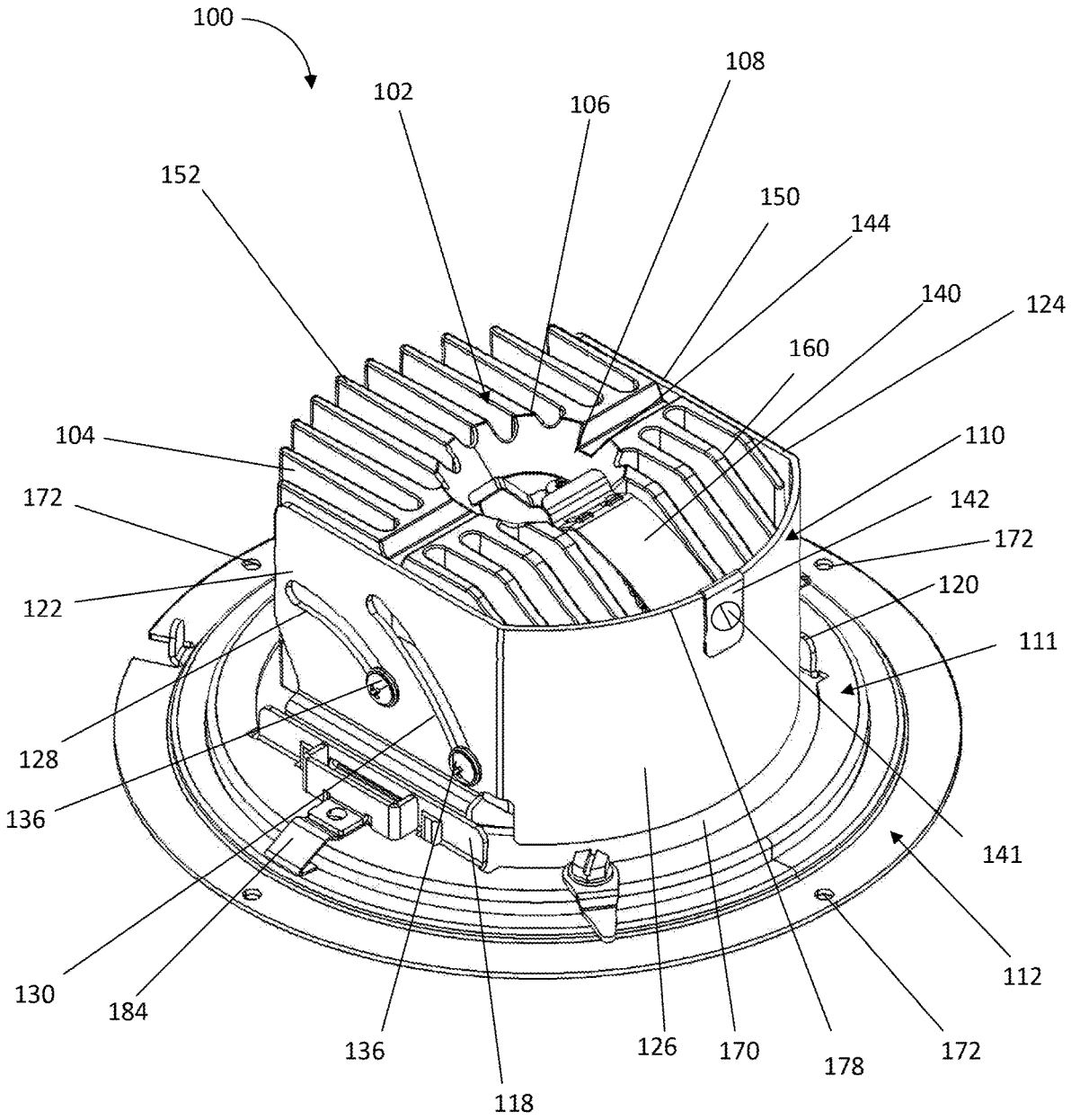
FIG. 4 illustrates a top front perspective view of an example embodiment of the adjustable assembly of FIG. 3 according to one or more aspects described herein.

FIGS. 1 and 3-11 illustrate an exemplary adjustable assembly 100. The adjustable assembly 100 may comprise a heatsink 102 that may include a plurality of cooling fins 104 connected together with a central region 106. The heatsink 102 may also include a plurality of locking steps 108 extending from the central region 106 along an upper surface of at least one of the cooling fins 104. For example, as shown in FIGS. 1 and 3-11, the plurality of locking steps 108 are positioned along the upper surfaces of two cooling fins 104. The locking steps 108 may be positioned along the upper surfaces of two cooling fins 104 that are located in the center or along the centerline 101 of the heatsink 102 between a first side wall 122 and a second side wall 124 (as illustrated in FIG. 3).

In another embodiment without departing from this invention, the locking steps 108 may be positioned on a single cooling fin 104 or three or more cooling fins 104. Alternatively, the locking steps 108 may be positioned along any number of cooling fins 104 as the number of cooling fins 104 with locking steps 108 may be dependent upon the number of cooling fins 104 as well as the spacing between the cooling fins 104.

The plurality of locking steps 108 as a whole may form a generally arcuate or rounded shape. The individual locking steps 108 may be spaced to correspond to an angular tilt increment for the heatsink 102 to provide incremental fine angle tilt adjustment. Thus, the locking steps 108 may be unevenly spaced from a first lock step 108 to the proceeding locking step and next locking step. Alternatively, the locking steps 108 may be evenly spaced from a first lock step 108 to the proceeding locking step and the next locking step. The locking steps 108 may be regularly-spaced or irregularly-spaced with the pitch varying to provide different increments and different pitches for the locking steps. In one embodiment, each locking step provides a 2-degree tilt angle adjustment increment.

As shown in FIG. 3, the heatsink 102 may be connected to a mounting bracket 110 where the mounting bracket 110 may comprise a first side wall 122, a second side wall 124, and a front wall 126 extending between the first side wall 122 and the second side wall 124. The front wall 126 provides at least one or more of the below features and functions: 1) provide a structural support to the first wall 122 and the second side wall 124 to ensure correct placement of the heatsink 102 between the first side wall 122 and the second side wall; 2) cover the internal area of the downlight fixture assembly 10 when the heatsink 102 is in a tilted configuration; 3) provide a connection means and support for a tension spring 140 for the tilting of the heatsink 102.

As illustrated in FIGS. 1 and 3-11, a rotation ring 111 may be secured to the mounting bracket 110. The rotation ring 111 may provide a means for the mounting bracket 110 (with heatsink 102) to rotate. A retaining wire 190 may secure the mounting bracket 110 and heatsink 102 to the rotation ring 111. The rotation ring 111 may comprise a first tab 118 near a first side and a second tab 120 near a second side opposite the first side. The retaining wire 190 may install by flexing into the adjustable assembly 100 and may be formed to have a first portion 192 that extends into a first elongated slot 119 positioned in the first tab 118 and a second portion 194 that extends into a second elongated slot 121 positioned in the second tab 120. The retaining wire 190 allows the mounting bracket 110 along with the heatsink 102 to be easily released from the rotation ring 111 without the use of a tool.

Figure 2A:
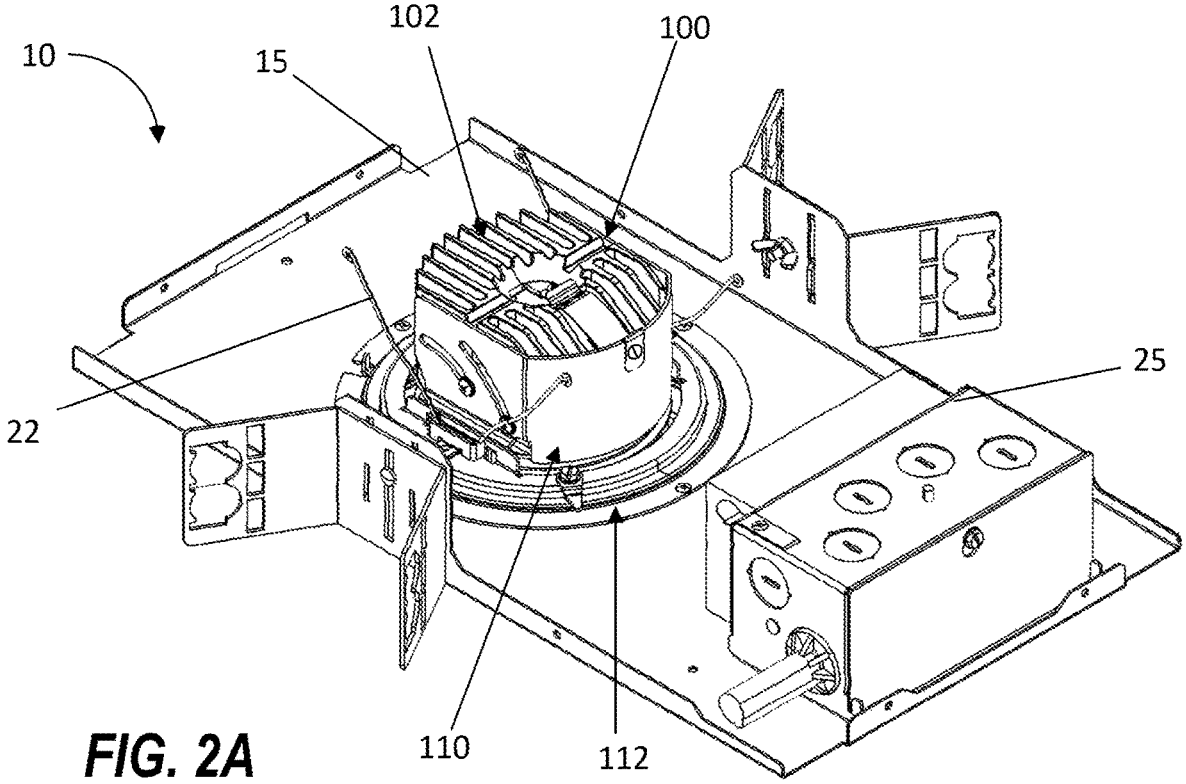
FIG. 2A illustrates a top perspective view of an example embodiment of the adjustable assembly of FIG. 1 installed into a light fixture with an upper cover removed for clarity according to one or more aspects described herein.
Figure 2B:
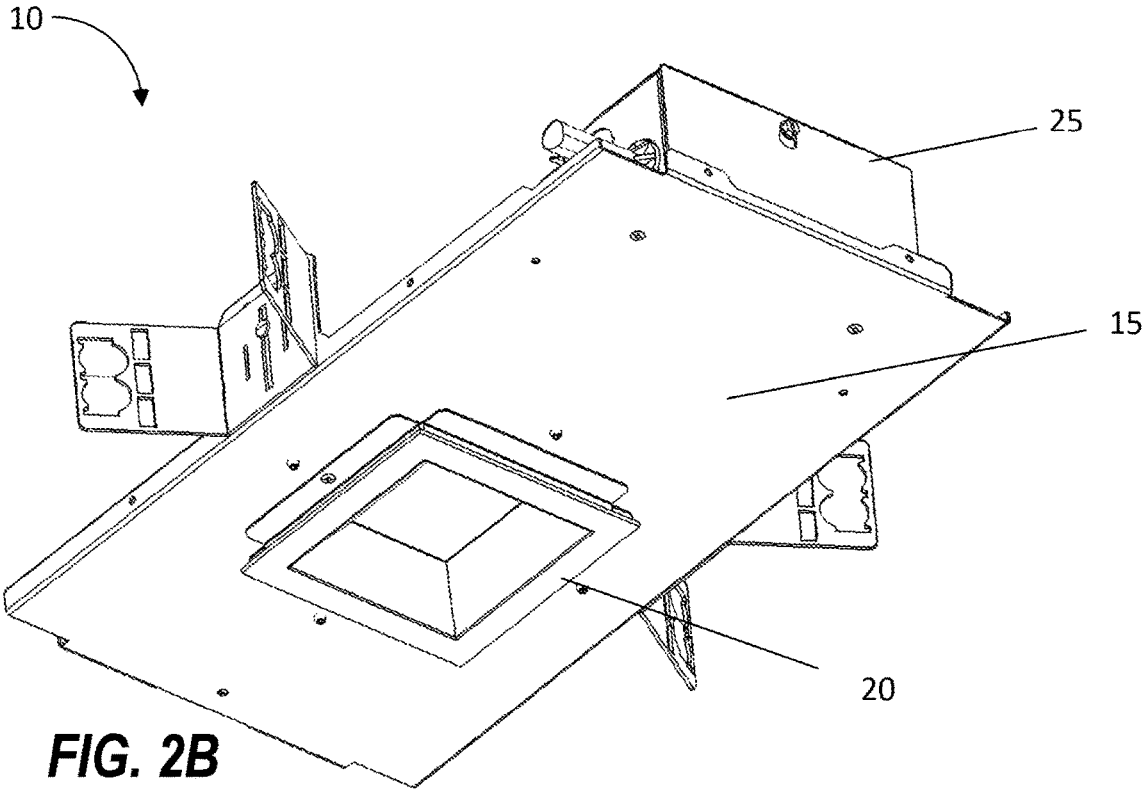
FIG. 2B illustrates a bottom perspective view of the example light fixture of FIG. 2A according to one or more aspects described herein.

Additionally, the rotation ring 111 may be secured to a mounting plate 112 that connects to a downlight fixture 10 (shown in FIGS. 2A and 2B). The adjustable assembly 100 may include a first friction spring 184 positioned near the first side wall 122 and second friction spring 186 near the second side wall. The mounting plate 112 may be positioned over a portion of the top surface 174 of the rotation ring 111. The friction spring 184, 186 may comprise a tension spring or leaf spring to apply a downward force on the mounting plate 112 to better secure the rotation ring 111.

Each of the first side wall 122 and the second side wall 124 may comprise a plurality of openings 128, 130 (openings/slots on the second side wall 124 are not in view) or slots extending through them respectively. The heatsink 102 may be connected to the first side wall 122 with a first set of securing members 136 extending through a first set of slots 128, 130. Additionally, the heatsink 102 may be connected to the second side wall 124 with a second set of securing members (not in view) extending through a second set of slots (not in view). The securing members 136 on both the first side wall 122 and the second side wall 124 and are fixed to the heatsink 102, but are free to move along their respective slots 128, 130. Thus as the securing members 136 move along their respective slots 128, 130, the heatsink 102 may rotate relative to the mounting bracket 110.

Figure 11:
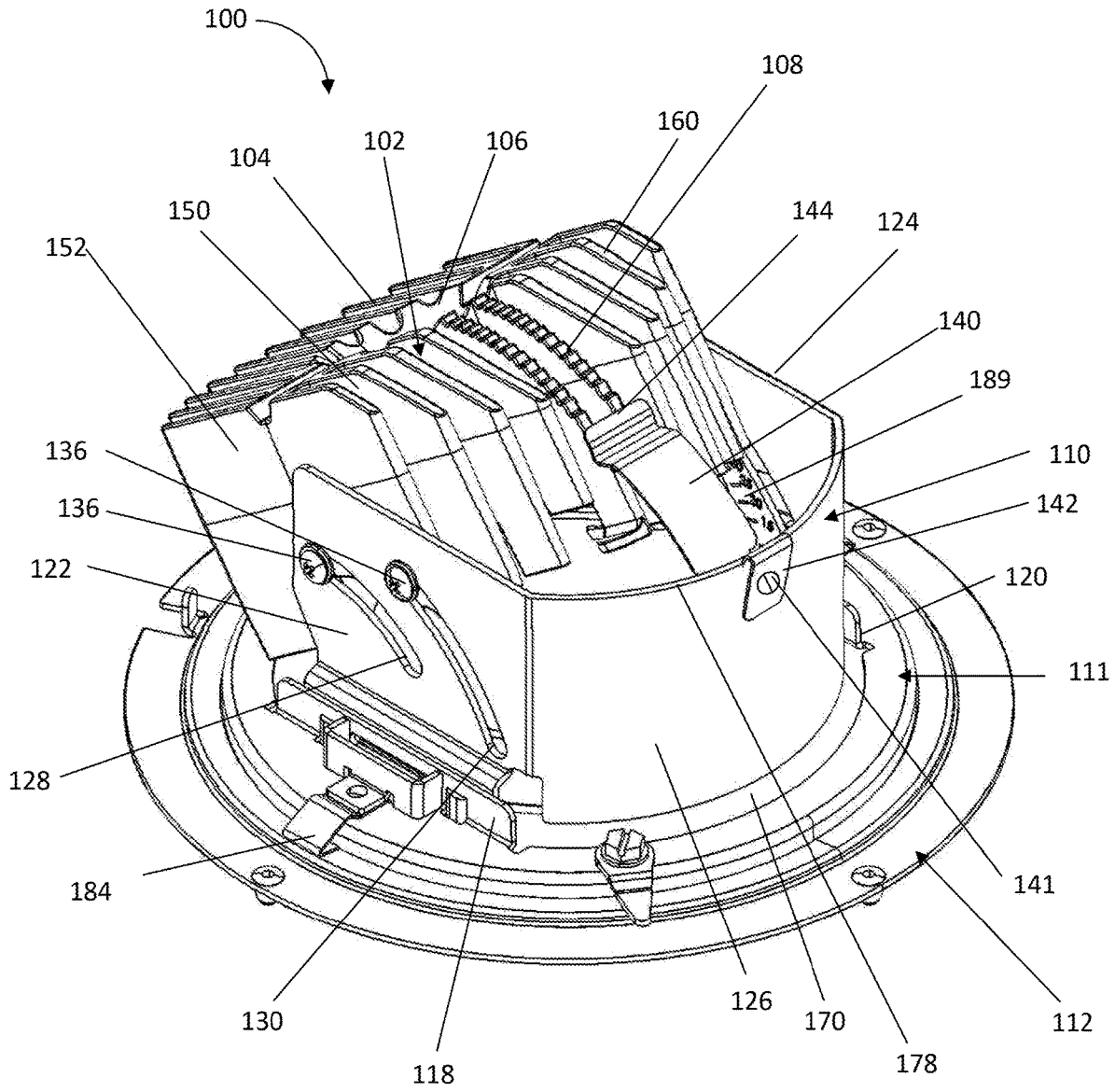
FIG. 11 illustrates a top front perspective view of the adjustable assembly of FIG. 1 in a fully rotated position according to one or more aspects described herein.
Figure 12:
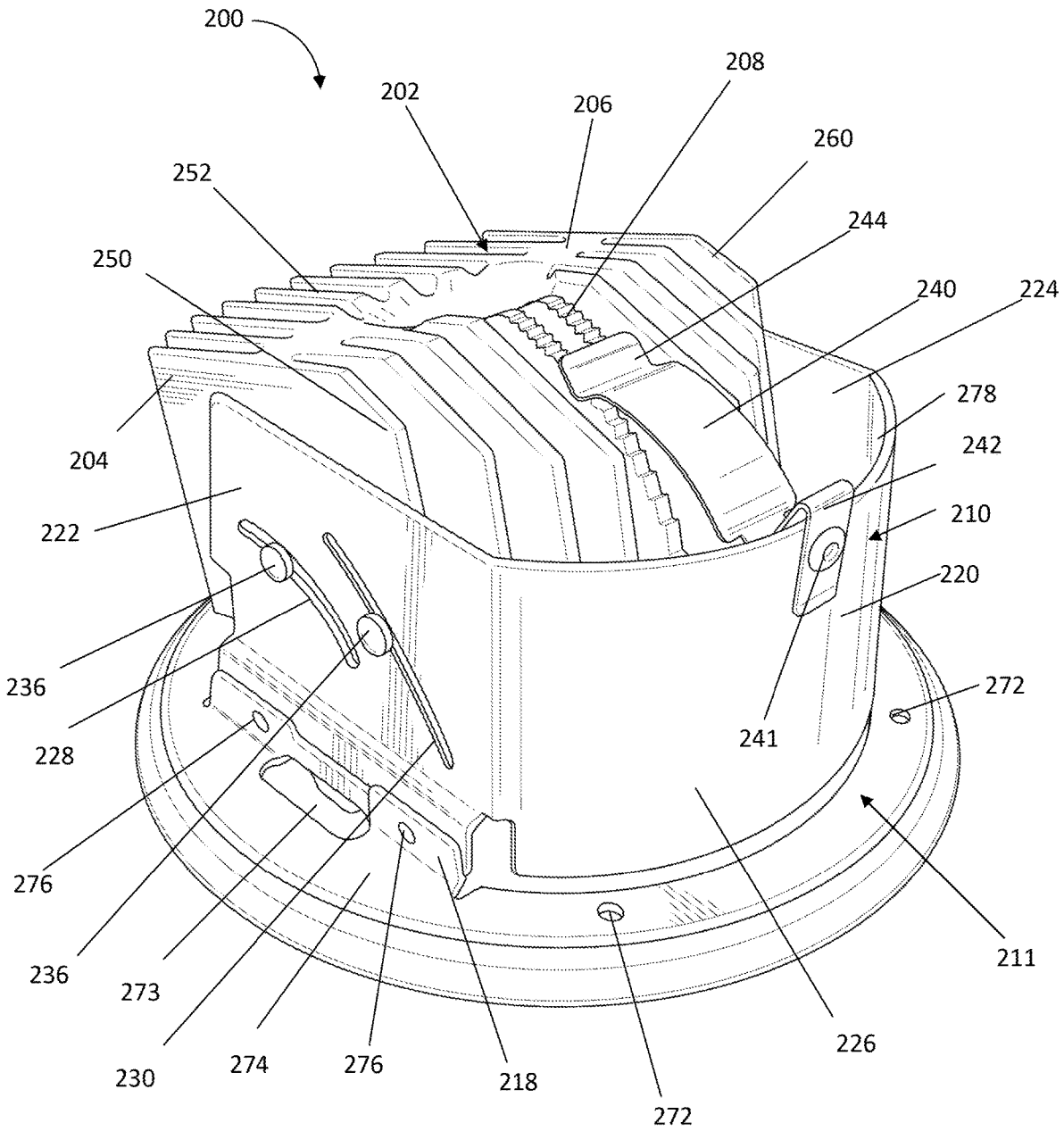
FIG. 12 illustrates a top front perspective view of an alternate embodiment of the adjustable assembly of FIG. 1 in a partially rotated position according to one or more aspects described herein.
Figure 13:
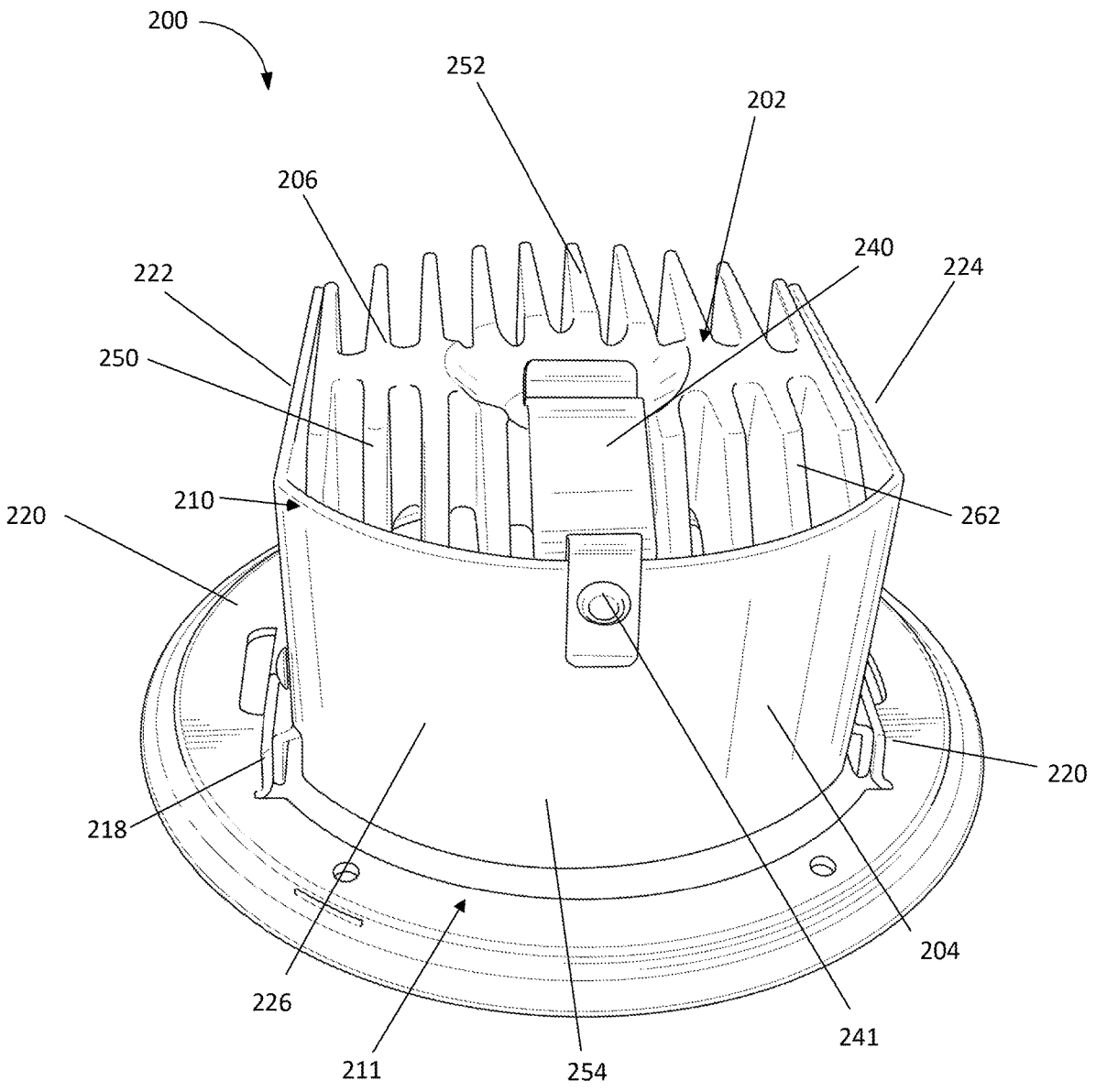
FIG. 13 illustrates a front perspective view of the alternate embodiment of the adjustable assembly of FIG. 12 in according to one or more aspects described herein.

Additionally, the adjustable assembly 100 may include a tension spring 140. The tension spring 140 may have a first end 142 attached to the front wall 126 and a second end 144 engaged with the plurality of locking steps 108. The second end 144 of the tension spring 140 may be engaged with the plurality of locking steps 108 positioned along the upper surface of at least one of the plurality of cooling fins 104. The first end 142 of the tension spring 140 may be centrally located along the front wall 126. The tension spring 140 may be connected to the front wall 126 with a securing member 141 on the first end 142 of the tension spring 140. The tension spring 140 may apply a tension force to the plurality of locking steps 108 to keep the heatsink 102 in a fixed position. Further, the tension spring 140 may apply a tension force to a set location on the plurality of locking steps 108 to correspond to a particular angle of tilt measured from the bottom surface of the rotation ring 111. In addition, either one or both of the side walls 122, 124 may have a set of tilt indicators 189 (as shown in FIG. 11) to indicate the angle of tilt of the heatsink 102. The tilt indicators 189 may be preferably on an inside surface of the side walls 122, 124, but may be located on an outer surface of the side walls 122, 124.

Figure 5:
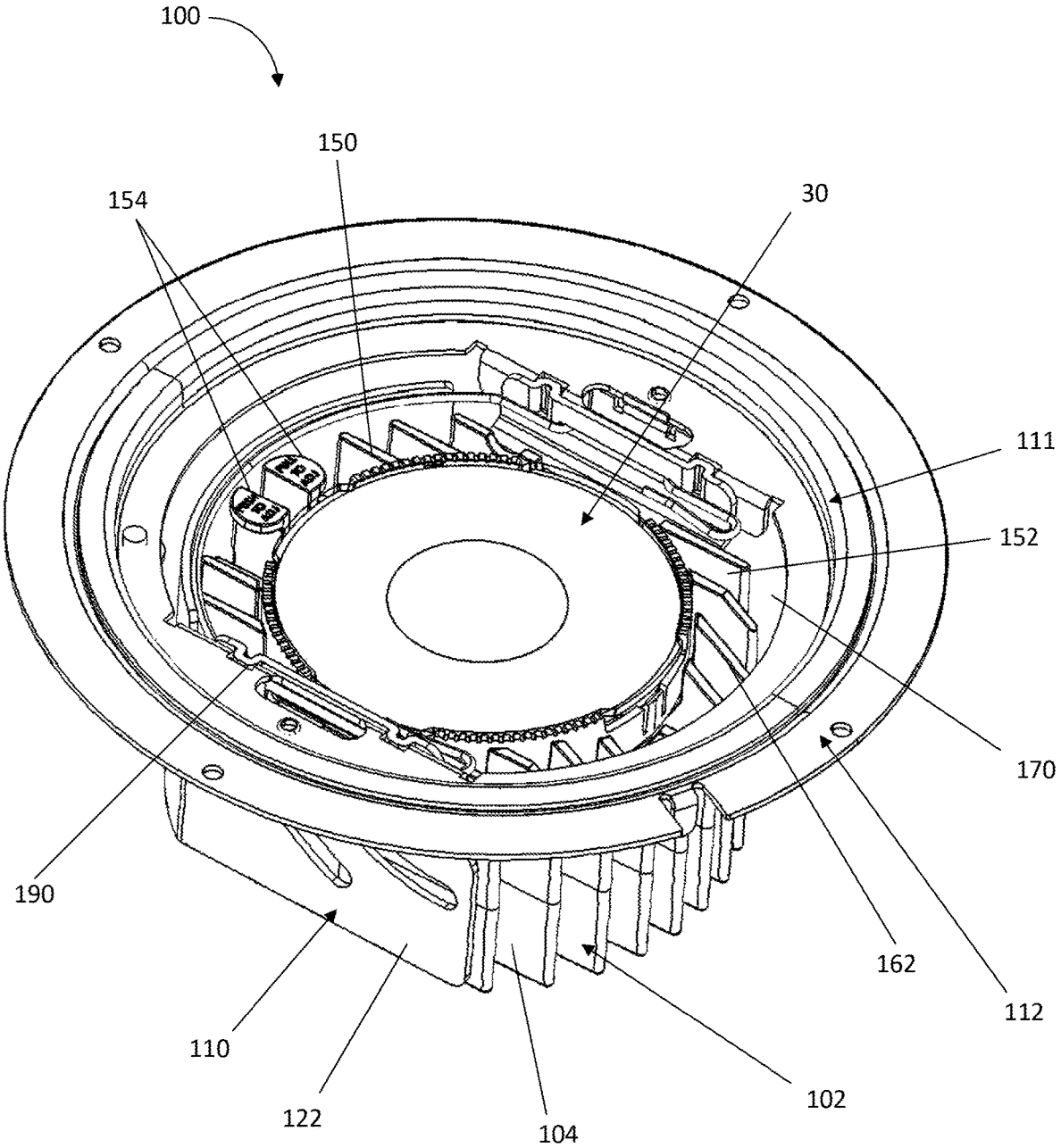
FIG. 5 illustrates a bottom front perspective view of an example embodiment of the adjustable assembly of FIG. 3 according to one or more aspects described herein.
Figure 6:
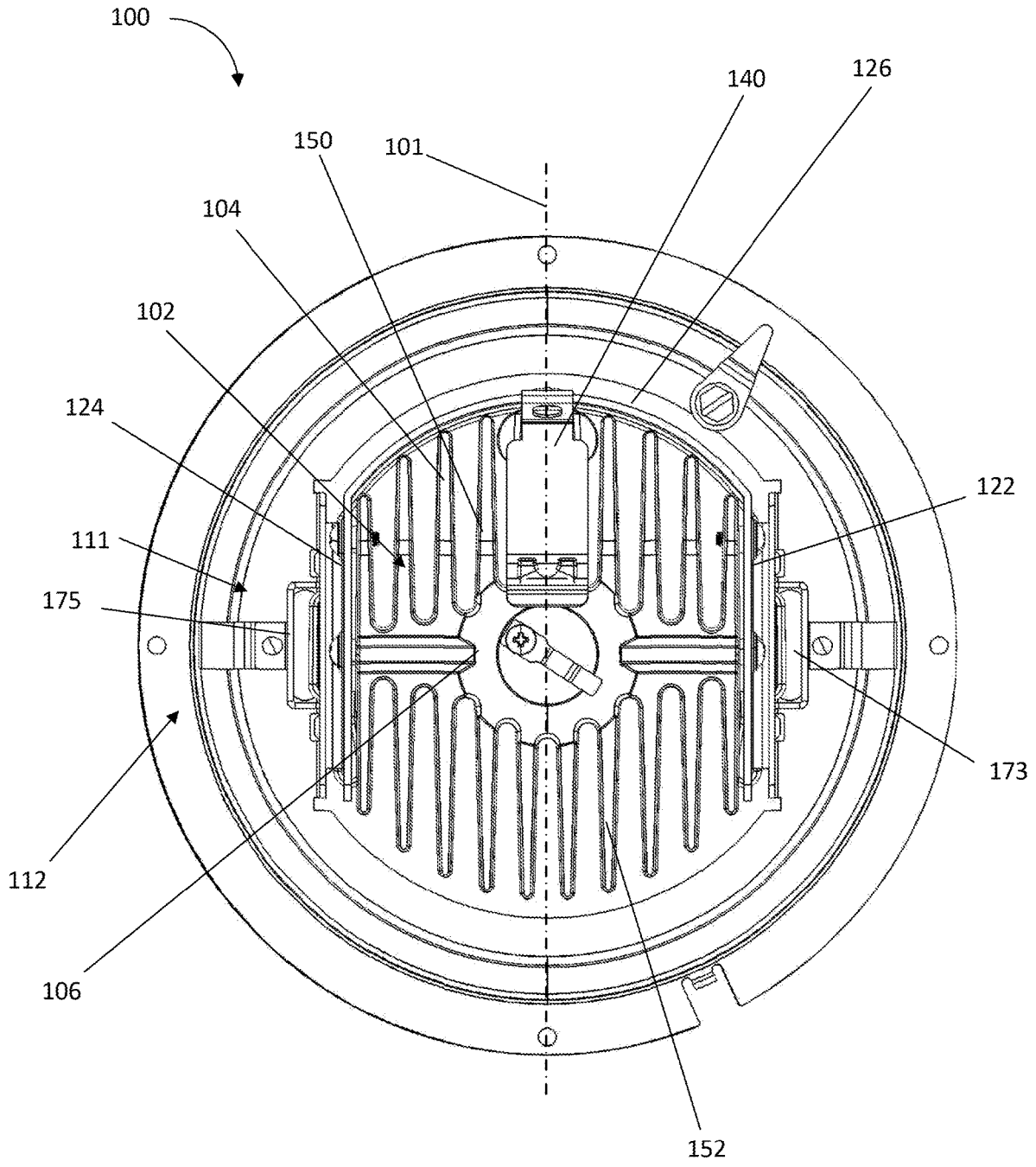
FIG. 6 illustrates a top view of the adjustable assembly of FIG. 3 according to one or more aspects described herein.
Figure 7:
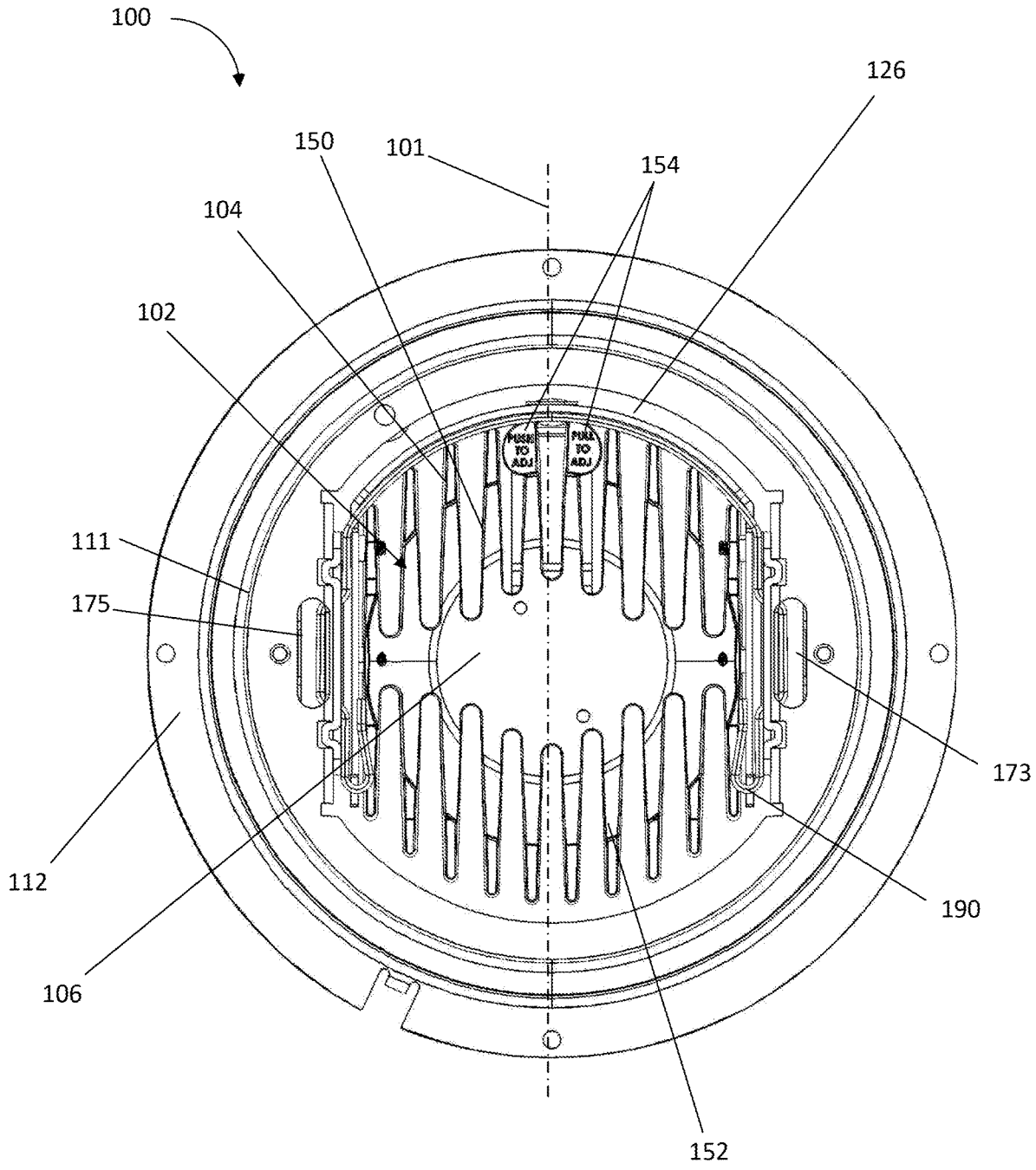
FIG. 7 illustrates a bottom view of the adjustable assembly of FIG. 3 according to one or more aspects described herein.
Figure 8:
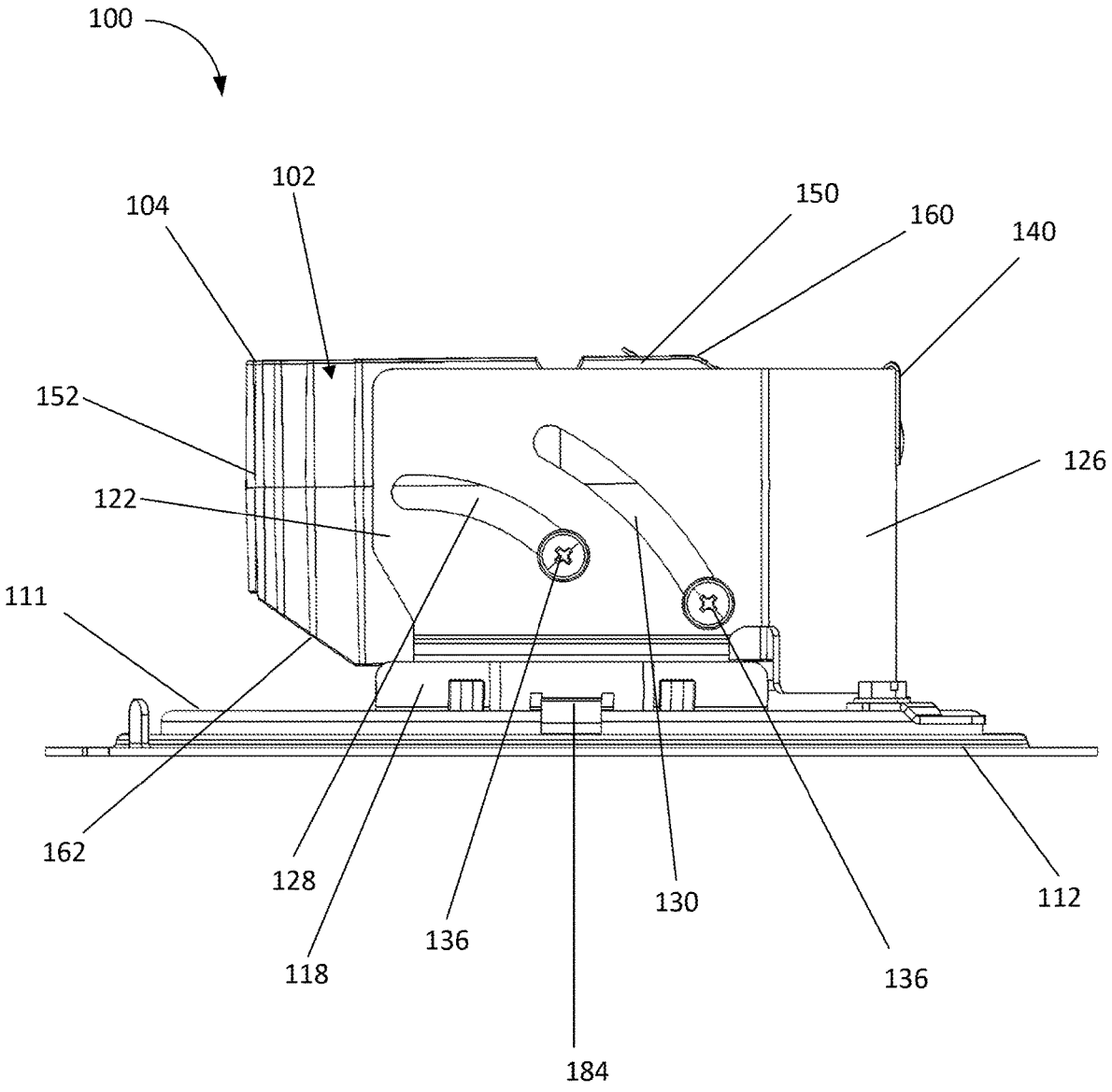
FIG. 8 illustrates a side view of the adjustable assembly of FIG. 3 according to one or more aspects described herein.
Figure 9:
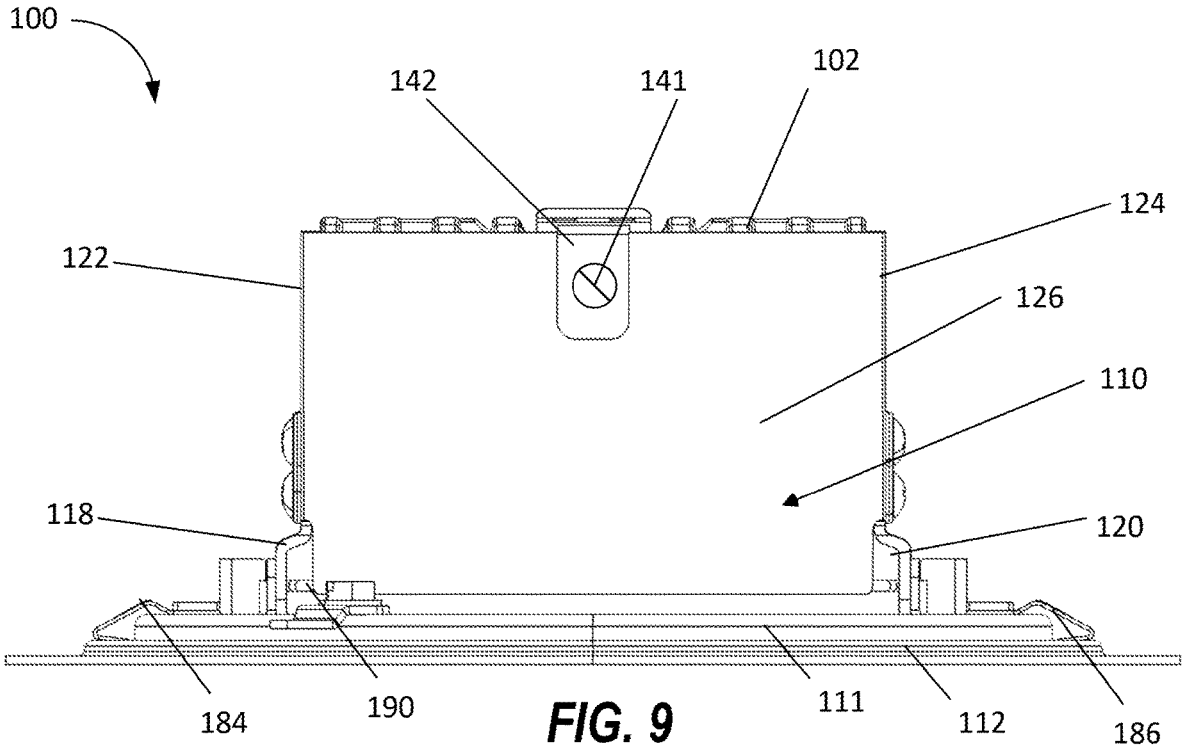
FIG. 9 illustrates a front view of the adjustable assembly of FIG. 3 according to one or more aspects described herein.
Figure 10:
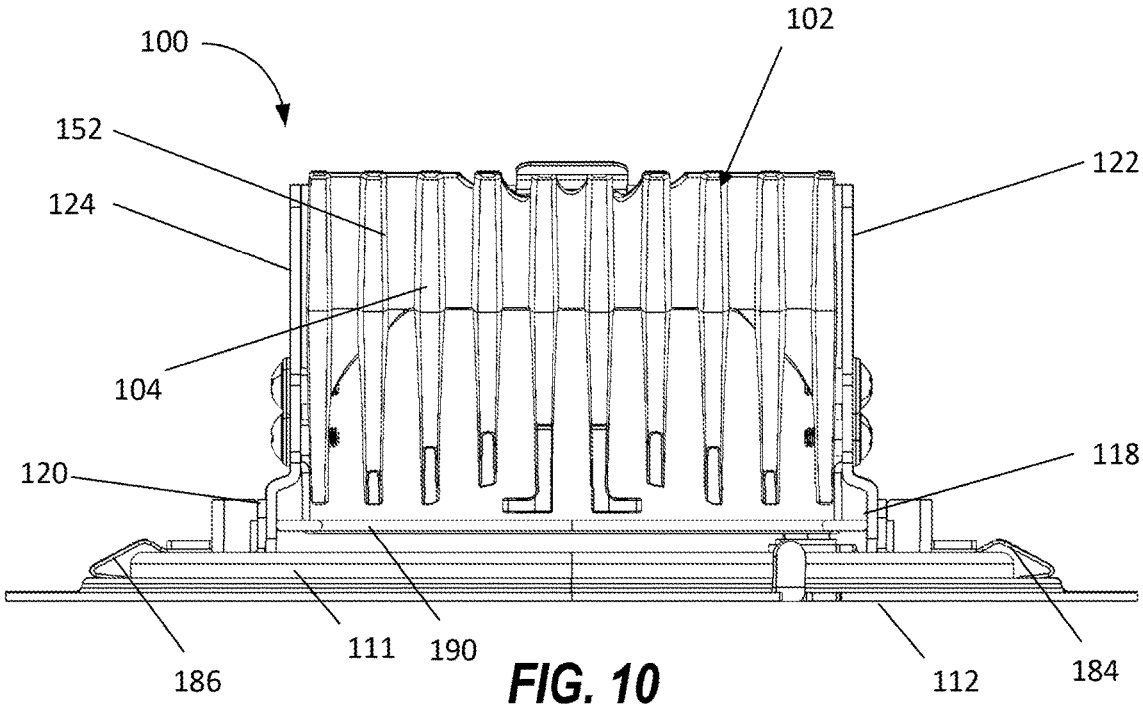
FIG. 10 illustrates a rear view of the adjustable assembly of FIG. 3 according to one or more aspects described herein.

In order to adjust the tilt of the heatsink 102 and thereby adjust the tilt of the light beam of the light source, a user may apply a force by either pushing or pulling on the heatsink 102 to overcome the tension force applied by the tension spring 140. As shown in FIGS. 5 and 7, the heatsink 102 may include a pair of adjustment tabs 154. The adjustment tabs 154 may be located at an end of at least one of the cooling fins 104 or more specifically, the adjustment tabs 154 may be located at an end of the center cooling fins 104 where the locking steps 108 are located. The user may apply a force to the adjustment tabs 154 by either pushing or pulling on the adjustment tabs 154 to overcome the tension force applied by the tension spring 140 in order to rotate the heatsink 102. Then, the tension spring 140, in a ratcheting motion, applies the tension force to either the preceding or next locking step 108 depending on the direction of the force applied by the user to provide an incremental angle adjustment of the heatsink 102 without the user needing a tool. Additionally, the tension of the tension spring 140 keeps the heatsink 102 free from movement or vibration while installed in a downlight fixture assembly 10.

FIGS. 2A and 2B show an exemplary downlight fixture assembly 10 with the adjustable assembly 100 installed. FIGS. 2A and 2B have an upper cover (not shown) of a fixture housing removed in order to show the details of the installed adjustable assembly 100. The mounting plate 112 of the adjustable assembly 100 may be mounted to an upper surface of a plaster frame 15 and substantially centered over a trim assembly 20. A power supply 25 may regulate power to the light source (not shown) in the heatsink 102. The trim assembly 20 may be mounted to a lower surface of the plaster frame 15 and secured to the rotation ring 111 of the adjustable assembly 100. Since the downlight fixture assembly 10 may have limited space within a ceiling, such as a limited plenum space, the adjustable assembly 100 may be limited in an overall height for both a non-tilted and fully-tilted configuration. For example, when the heatsink 102 is in a 0-degree position as shown in FIGS. 3-10, the top surface of the heatsink 102 may be generally coplanar to the top surface 178 of the first side wall 122, second side wall 124, and front wall 126. In other words, the height of the heatsink in a 0-degree position may be the same height as the first side wall 122, second side wall 124, and front wall 126 when measured from the bottom surface of the rotation ring 111. However, when the heatsink 102 is in a fully-tilted configuration as shown in FIG. 11, the angled surface (chamfered upper edge 160) of the heatsink 102 is generally higher than the first side wall 122, second wall 12, and front wall 126.

The heatsink 102 as discussed above may have a plurality of cooling fins 104. The heatsink 102 acts as a passive heat exchanger using the plurality of cooling fins 104 to dissipate the heat generated by the light source away from the light source to keep the light source operating at the optimal temperature. The plurality of cooling fins 104 may comprise of a first set of cooling fins 150 extending from the central region 106 and a second set of cooling fins 152 extending from an opposite side of the central region 106.

The heatsink 102 may comprise any number of cooling fins 104. For example, the exemplary heatsink 102 shown in FIGS. 1-11 comprises ten cooling fins on each side of the central region 106. However, the number of cooling fins 104 may depend on the overall size of the heatsink 102, the environmental operating conditions, the size and power requirements of light source being used, and/or the material of the heatsink 102.

The first set of cooling fins 150 may have a chamfered upper edge 160 to limit the overall height of the adjustable assembly 100 when the heatsink 102 is in a fully-tilted position. Similarly, the second set of cooling fins 152 may have a chamfered lower edge 162 to avoid any interference with the rotation ring 111 and/or mounting plate 112 or plaster frame 15 when the heatsink 102 is in a fully-tilted position.

The rotation ring 111 may be formed separately and be releasably connected to the mounting bracket 110. Alternatively, the rotation ring 111 may be permanently joined to mounting bracket 110. As another aspect, the mounting bracket 110 and rotation ring 111 may be formed as a single piece. Additionally, mounting bracket 110 may be formed as a single piece which ensures that the first side wall 122 and the second side wall 124 are aligned with the adjustable assembly 100. The front wall 126 provides at least three important features and functions: 1) provides a surface for mounting the tension spring 140; 2) locks the sidewalls 122, 124 into position for support and alignment with the adjustable assembly 100; and 3) blocks any view into the fixture housing when the adjustable assembly 100 is tilted.

The rotation ring 111 may have a circular exterior shape as shown in the exemplary embodiment of FIGS. 1-11. The rotation ring 111 may also have a centrally located opening 170 that generally follows the exterior shape.

The rotation ring 111 may further include a pair of elongated openings 173, 175 adjacent the central opening 170 or adjacent to each tab 118, 120. The tabs 118, 120 may extend generally perpendicular to a top surface 174 of the rotation ring 111. The elongated openings 173, 175 may be centrally located on the along each tab 118, 120. The elongated openings 173, 175 allow the rotation ring 111 to receive the securing members 22 for the trim assembly 20 of the downlight fixture assembly 10.

The mounting plate 112 may have a circular exterior shape as shown in the exemplary embodiment of FIGS. 1-11. Alternatively, the mounting plate 112 may be any symmetrical exterior shape such as a square or rectangle. The rotation ring 111 may have a centrally located opening that generally follows the exterior shape. The mounting plate 112 may also comprise a plurality of mounting holes 172 extending through and positioned around the mounting plate 112.

The first side wall 122 and the second side wall 124 of the mounting bracket 110 may comprise a planar exterior surface. The front wall 126 may have a rounded exterior surface while connecting the first side wall 122 and the second side wall 124. The top surfaces 178 of the first side wall 122, the second side wall 124, and the front wall 126 may form a continuous planar surface.

As previously mentioned, the first side wall 122 has a plurality of elongated openings or slots 128, 130 that are spaced apart from one another. Similarly, the second side wall 124 has a plurality of openings or slots (not shown) that are spaced apart from one another. Each slot 128, 130, may have a generally arcuate shape, where slot 128 may have more curvature than the slot 130. The width of each slot 128, 130 may be substantially constant and may be slightly larger than the diameter of the securing member 136 such that the inner surface of each slot 128, 130 engages and is in communication with the exterior surface of its corresponding securing member 136.

The front wall 126 may have an opening (not shown) to attach the tension spring 140 to the mounting bracket 110. The opening may be centrally located along the centerline 101. The tension spring 140 may have a first end 142 that is formed to fit around the top surface 178 of the front wall 126 and a curvature configured to apply a force to the locking steps 108. The tension spring 140 may also have a mounting hole to receive a securing member 141 to connect it to the front wall 126.

The securing members 136 may releasable mechanical fasteners having a threaded portion on one end. The securing members 136 may further have a smooth surface that extends and engages the slots 128, 130. In addition, the securing members 136 may include a bushing to engage the inner surfaces of the respective slots 128, 130. The bushing may be made of a friction reducing material. The bushing may also comprise a shoulder such that the bushing engages both the inner surface of the respective slots 128, 130 and the respective exterior surfaces of the first side wall 122 and the second side wall 124 as the securing members 136 move along the respective slots 128, 130.

The securing member 141, may be a releasable mechanical fastener such as a threaded fastener, like a screw. Alternatively, the securing members 141 may be a more permanent mechanical fastener like a rivet.

FIGS. 12-15 illustrate an alternate embodiment of the adjustable assembly 100. FIGS. 12-15 show the adjustable assembly 200 without the mounting plate, which has been removed for clarity. For embodiment of FIGS. 12-15, the features are referred to using similar reference numerals under the "2xx" series of reference numerals, rather than "1xx" as used in the embodiment of FIGS. 1-11. Accordingly, certain features of the adjustable assembly 200 that were already described above with respect to adjustable assembly 100 of FIGS. 1-11 may be described in lesser detail, or may not be described at all.

Figure 14:
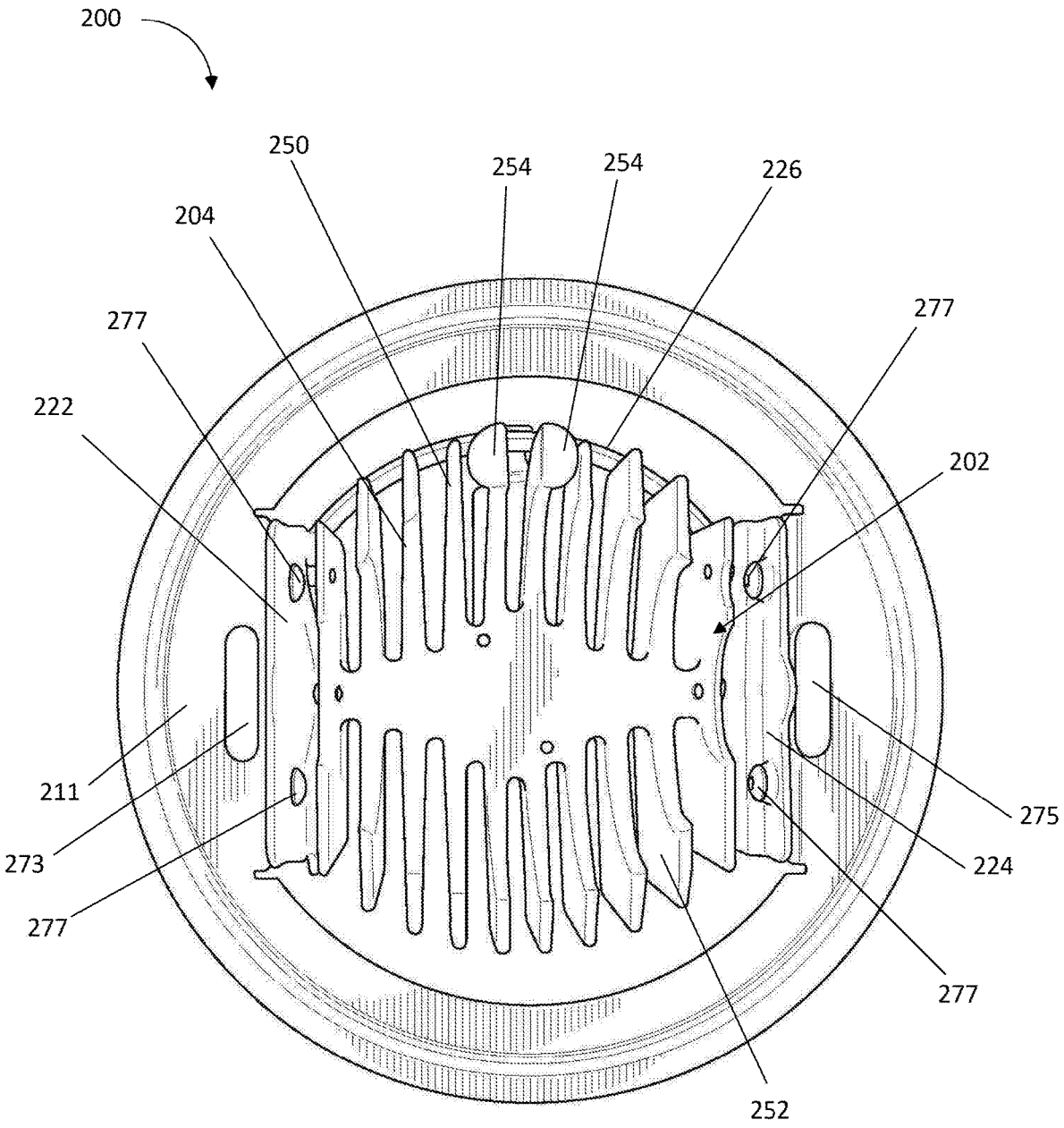
FIG. 14 illustrates a bottom view of the alternate embodiment of adjustable assembly of FIG. 12 according to one or more aspects described herein.
Figure 15:
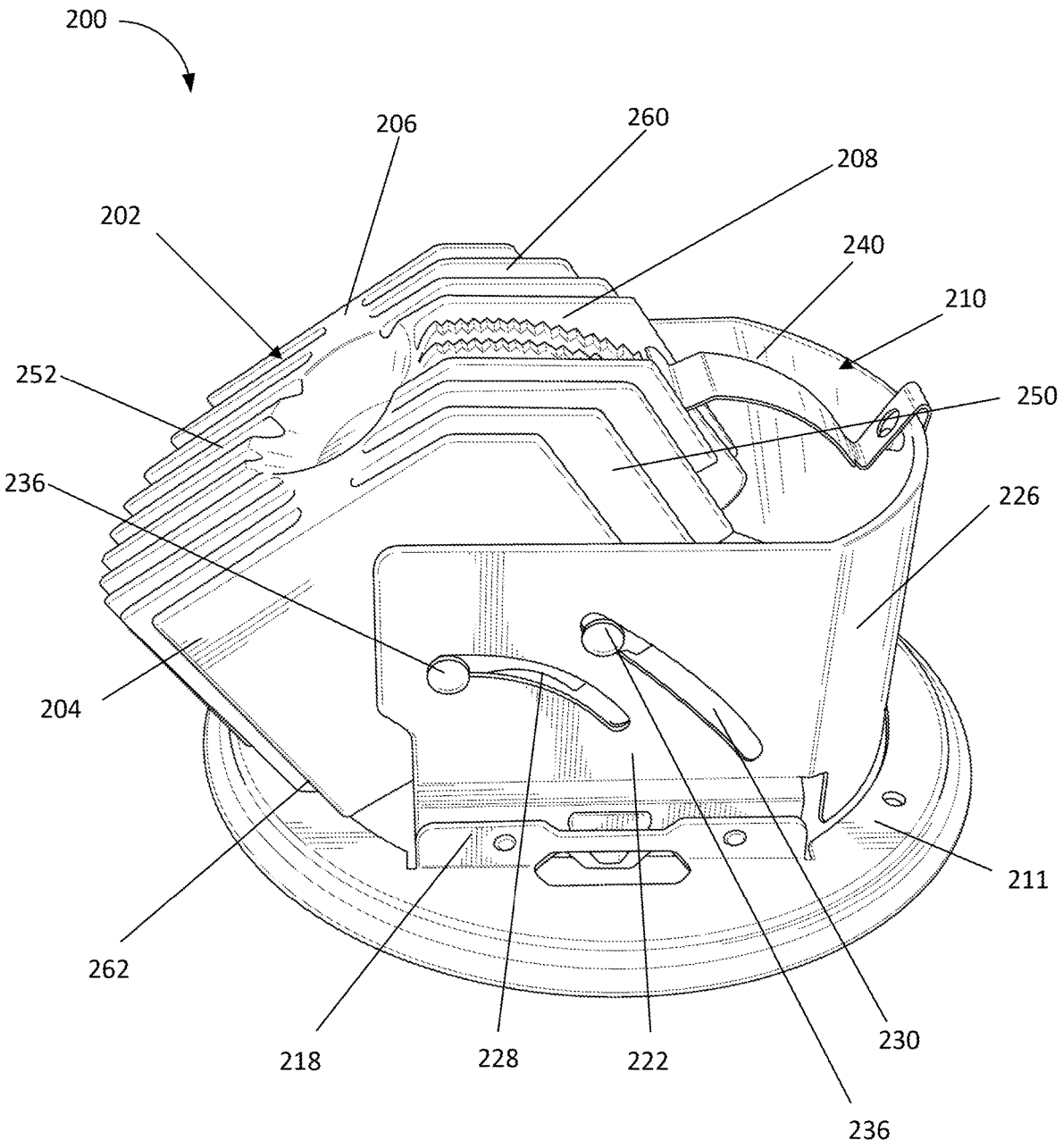
FIG. 15 illustrates a side perspective view of the alternate embodiment of the adjustable assembly of FIG. 12 in a fully rotated position according to one or more aspects described herein.

Similar to the embodiments of FIGS. 1-11, the mounting bracket 210 may be releasably connected to the rotation ring 211. In the embodiment of FIGS. 12-15, the mounting bracket 210 may be connected to rotation ring 211 using a plurality of fasteners. Each tab 218, 220 on the rotation ring 211 may comprise a plurality of mounting holes 276. For example, as shown in FIG. 14, the first side wall 222, the second side wall 224, and the front wall 226 may be connected to the rotation ring 211 by securing members 277 extending into the mounting holes 276 on the tabs 218, 220 instead of being secured with the retaining wire 190.

According to various aspects and embodiments, the heatsink 102, the mounting bracket 110, rotation ring 111, and mounting plate 112 may be formed of one or more of a variety of metallic materials (including metal alloys), such as, but not limited to, aluminum, aluminum alloys, copper, copper alloys, steels (including stainless steels), titanium, and titanium alloys. The material may be chosen not only for its thermally conductive properties, but also its density and strength properties as reducing weight may be a concern.

The heatsink 102 may be produced by various manufacturing methods, but may be preferably formed from a casting or extrusion process. The heatsink 102 may be integrally formed as a single piece using a die casting process, investment casting process, permanent mold casting or even using a metal injection molding process. Alternatively, the heatsink 102 may be formed using by extruding, forging, and/or machining process.

The mounting bracket 110, the rotation ring 111, and the mounting plate 112 may be preferably produced from a stamping and forming processes, such as sheet metal forming operations, although it may be formed using a casting, deep draw or hydroform process as well. Thus, the wall thickness of the rotation ring 111 and tabs 118, 120 may have a constant wall thickness. Similarly, the first side wall 122, the second side wall 124, and the front wall 126 may have a constant wall thickness. The mounting plate 112 may have a constant wall thickness as well.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. An adjustable assembly for a downlight comprising:

a mounting bracket;

a heatsink configured to receive a light source, the heatsink comprising a plurality of cooling fins and connected to the mounting bracket; and a rotation ring connected to the mounting bracket and rotatably engaged to a downlight fixture assembly;

wherein the mounting bracket comprises:

a first side wall connected to the rotation ring and the heatsink, a second side wall opposite the first side wall and connected to the rotation ring and the heatsink, and a front wall extending between the first side wall and the second side wall, wherein the heatsink is positioned between the first side wall and the second side wall, the first side wall having a first plurality of slots extending through the first side wall and the second side wall having a second plurality of slots extending through the second side wall, wherein the heatsink is connected to the first side wall with a first set of securing members extending through the first plurality of slots and is connected to the second side wall with a second set of securing members extending through the second plurality of slots, and wherein the heatsink is tiltably engaged with the mounting bracket, and further including a tension spring having a first end attached to the front wall and a second end engaged with a plurality of locking steps positioned along an upper surface of at least one cooling fin of the heatsink, wherein the tension spring applies a tension force to the plurality of locking steps to keep the heatsink in a fixed position, wherein the heatsink is tilted by slidable engagement along the first plurality of slots and the second plurality of slots to overcome the tension force of the tension spring to allow ratcheting of the tension spring into different angles of the locking steps along an upper surface of the heatsink, wherein the tilting of the heatsink tilts a light beam from the light source.

2. The adjustable assembly for a downlight of claim 1, wherein the rotation ring has a top surface and a bottom surface with a first tab extending away from the top surface and a second tab extending away from the top surface.

3. The adjustable assembly for a downlight of claim 1, wherein the plurality of locking steps include individual locking steps that are spaced to correspond to an angular increment for the heatsink to provide incremental fine angle tilt adjustment of the heatsink.

4. The adjustable assembly for a downlight of claim 1, wherein the heatsink tilts within a range of 0 degrees to 45 degrees from a vertical plane.

5. The adjustable assembly for a downlight of claim 1, wherein the plurality of locking steps is centered upon a centerline of the heatsink between the first side wall and second side wall.

6. The adjustable assembly for a downlight of claim 1, wherein the plurality of cooling fins are connected by a central member and the plurality of cooling fins comprise a first set of cooling fins on a first side of the central member and a second set of cooling fins on a second side of the central member, wherein the first set of cooling fins have at least one cooling fin with a chamfered upper edge.

7. The adjustable assembly for a downlight of claim 1, wherein the first plurality of slots on the first side wall and the second plurality of slots on the second side wall have arcuate shapes.

8. The adjustable assembly for a downlight of claim 1, further including adjustment tabs located at an end of at least one of the cooling fins where the locking steps are located and further wherein a user applies a force to the adjustment tabs by either pushing or pulling on the adjustment tabs to overcome the tension force applied by the tension spring in order to tilt the heatsink.

9. A downlight fixture assembly comprising:

a plaster frame;

a trim assembly mounted to a lower surface of the plaster frame; and an adjustable assembly mounted to an upper surface of the plaster frame and substantially centered over the trim assembly, the adjustable assembly comprising:

a mounting bracket comprising:

a first side wall having a first pair of arcuate slots, a second side wall having a second pair of arcuate slots positioned opposite the first side wall, and a front wall extending between the first side wall and the second side wall;

a rotation ring connected to the first side wall and the second side wall; wherein the rotation ring is rotatably engaged with the plaster frame;

a heatsink configured to receive a light source, the heatsink comprising a plurality of cooling fins, wherein the heatsink is positioned between the first side wall and the second side wall and is connected to the first side wall with a first set of securing members extending through the first pair of slots and is connected to the second side wall with a second set of securing members extending through the second pair of slots, wherein the heatsink is tiltably engaged with the first side wall and the second side wall and the heatsink tilts by slidably engaging the first set of securing members along the first pair of slots and the second set of securing members along the second pair of slots thereby tilting a light beam from the light source; and a tension spring having a first end attached to the front wall and a second end engaged with a plurality of locking steps positioned along an upper surface of at least one cooling fin of the heatsink, wherein the tension spring applies a tension force to the plurality of locking steps to keep the heatsink in a fixed position, wherein the heatsink is tilted by slidably engaging along the first and second pair of slots to overcome the tension force of the tension spring to allow ratcheting of the tension spring into different angle locking steps along the upper surface of the heatsink.

10. The downlight fixture assembly of claim 9, wherein the plurality of cooling fins are connected by a central member and the plurality of cooling fins comprises a first set of cooling fins nearest to the front wall and a second set of cooling fins furthest from the front wall, wherein the first set of cooling fins have at least one cooling fin with a chamfered upper edge, and wherein the second set of cooling fins have at least one cooling fin with a chamfered lower edge.

11. The downlight fixture assembly of claim 9, wherein the trim assembly is secured to the mounting bracket of the adjustable assembly.

12. The downlight fixture assembly of claim 9, wherein the each of the plurality of locking steps are spaced to correspond to an angular increment for the heatsink to provide incremental fine angle tilt adjustment.

* * * * *